US006172669B1

(12) United States Patent
Murphy et al.

(10) Patent No.: US 6,172,669 B1
(45) Date of Patent: Jan. 9, 2001

(54) METHOD AND APPARATUS FOR TRANSLATION AND STORAGE OF MULTIPLE DATA FORMATS IN A DISPLAY SYSTEM

(75) Inventors: Michael W. Murphy, San Carlos; Paul A. Baker, Los Altos, both of CA (US)

(73) Assignee: Apple Computer, Inc., Cupertino, CA (US)

( * ) Notice: Under 35 U.S.C. 154(b), the term of this patent shall be extended for 0 days.

(21) Appl. No.: 09/067,740

(22) Filed: Apr. 28, 1998

Related U.S. Application Data

(62) Division of application No. 08/436,828, filed on May 8, 1995, now Pat. No. 5,867,178.

(51) Int. Cl.[7] ..... G09G 5/06

(52) U.S. Cl. ..... 345/199; 345/509; 345/154; 345/155

(58) Field of Search ..... 345/199, 150, 345/153, 154, 155, 186, 509, 113, 112, 114, 115, 116, 516, 213, 507

(56) References Cited

U.S. PATENT DOCUMENTS 4,908,610 * 3/1990 Yamamuro et al. ..... 345/199
4,992,961 * 2/1991 Petersen ..... 345/516
5,124,688 * 6/1992 Rumball ..... 345/199
5,402,148 * 3/1995 Post et al. ..... 345/213

* cited by examiner

*Primary Examiner*—Xiao Wu
(74) *Attorney, Agent, or Firm*—Burns, Doane, Swecker & Mathis, LLP

(57) ABSTRACT

The transfer of video and graphic data from a frame buffer to a display system is interleaved in a manner which permits operation with a reduced memory bandwidth. For those scan lines of a display in which the video information appears, video data is retrieved from the frame buffer during the horizontal blanking time of the scan. Graphical data is retrieved from the memory during the active portion of horizontal scan line. By alternating the retrieval of data in this manner, a lower bandwidth operation can be employed, thereby reducing the expenses of the memory. An address translator permits video and graphic data that is stored in different respective formats to be retrieved with a consistent addressing approach. The use of multiple color look-up tables permits full-color video to be displayed even if limited-color graphics are being employed.

20 Claims, 5 Drawing Sheets

METHOD AND APPARATUS FOR TRANSLATION AND STORAGE OF MULTIPLE DATA FORMATS IN A DISPLAY SYSTEM

This application is a divisional, of application Ser. No. 08/436,828, filed May 8, 1995, now U.S. Pat. No. 5,867,178,

FIELD OF THE INVENTION

The present invention is directed to computer systems that are capable of displaying both video and graphic information, particularly computer systems of this type in which the video and graphic data are stored in a shared memory.

BACKGROUND OF THE INVENTION

Computers with so-called multimedia capabilities offer the user the ability to process and display a variety of different types of information. Some computers within this general category have the ability to display a video presentation, as well as graphical information. In the context of the present invention, the term "graphic" refers to computer-generated pixel data that is displayed on a computer's monitor, whereas the term "video" refers to pixel data that is originally generated from an external source, such as an NTSC broadcast or a video tape, although it could be currently stored within the computer. Typically, the video presentation might be displayed in a window within the display area of the monitor. The frame of the window represents graphical information, whereas the contents of the window comprise the video presentation itself. In addition to the frame for the video presentation, other graphical elements might appear on the display screen. For example, additional windows, icons, and menu bars may be present on the screen.

For those portions of the display in which the video information appears, the display system determines whether the video data or the graphical data is to be displayed, based on color keying information contained within the display data, typically the graphical data. Normally, the video information will be displayed, so that the user can view an incoming video presentation in real time. However, if the user actuates a pulldown menu which overlaps the video window, for example, it is preferable to have the graphical data, i.e., the menu, displayed in the overlapping area, in lieu of the video information. As such, both the graphical and video data must be presented to the display system from memory, so that it can choose the proper information to display.

In the past, the video data and the graphical data were stored in separate memories, from which each could be simultaneously retrieved and presented to the display system. For more efficient memory utilization, and to reduce cost, it is desirable to employ a single memory buffer to store both the graphical and video information. For example, in one implementation of such an arrangement, a single memory device can be divided into three frame buffers. One of the frame buffers stores the graphical information, while the other two buffers store alternate frames of the video data. An incoming video frame is stored in one of the video buffers, while the immediately preceding frame is retrieved from the other video buffer and forwarded to the display.

Although the use of a single memory reduces the costs associated with storing graphical and video information, it also presents practical problems with respect to the retrieval of information. More particularly, in the portion of the display in which both the video and graphical data are presented to the display system, twice as much data must be retrieved from the memory. In other words, the memory must operate with sufficient speed, i.e., have enough bandwidth, to supply all of the data at the required rate. Otherwise, a single memory device cannot be practically employed to store both the graphical and the video information.

Another consideration associated with the use of a single memory for both graphical and video data relates to the addressing of the memory to retrieve the data. For maximum memory utilization, many computer systems store graphical data in a packed pixel format. In this approach, pixel data for a given scan line begins at the first byte following the byte containing the last pixel data for the immediately preceding line. In other words, there are no "unused addresses" in the memory between the data bytes for adjacent scan lines. This approach provides the advantage that there is a consistent, readily determined address offset between any two pixels of the display.

Video data might not be stored in the same manner, however. Generally speaking, it is desirable to store video data for a given scan line as a contiguous block, and not divide it over natural byte boundaries, such as different rows of the memory, for example. Thus, if the amount of data for an integer number of scan lines is not equal to the length one row of data in the memory, there will be unused address locations in each row of the video buffer. Because of this, the address offset between various pixels of the video information will not be consistent, making the retrieval of video data by the central processing unit of the computer more difficult.

A further consideration when both video and graphical information is displayed relates to the processing of data which defines each type of information. Typically, a color imaging system includes a color look-up table (CLUT) that maps pixel data into red, green and blue (RGB) component values for controlling the display monitor to generate desired colors. The CLUT is designed in accordance with the format of the pixel data, as well as the particular color palette designated by a user or an application program. If the video data is not in the same format as the graphical pixel data, the resulting video display can be adversely affected. For example, if the video data is in a format which employs 16 bits per pixel, but the graphical data only contains 8 bits per pixel, one-half of the color information for the video presentation will be lost if it is processed in a CLUT that is based on an 8-bit per pixel format.

Accordingly, it is desirable to provide a computer system in which video and graphic data can be stored in the same memory without the need to increase the bandwidth capacity of the memory, and to provide an address translator that enables both video data and graphical data to be easily retrieved from the memory. It is further desirable to provide a color processing system in which the video data is not constrained by the format of the graphical data.

SUMMARY OF THE INVENTION

In accordance with the present invention, the first one of these objectives is achieved by interleaving the transfer of video and graphic data from a frame buffer to a display system in a manner which permits operation with a reduced memory bandwidth. For those scan lines of the display in which the video information appears, video data is retrieved from the frame buffer during the horizontal blanking time of the scan. Graphical data is retrieved from the memory during the active portion of each horizontal scan line. By alternating the retrieval of data in this manner, rather than attempting to retrieve video and graphic data simultaneously, a lower bandwidth operation can be employed, thereby reducing the expenses of the memory.

In accordance with another aspect of the invention, an address translator is provided which makes the address locations of the video data appear to have the same format as a packed pixel approach, and thereby provide a consistent addressing scheme to the computer. The address translator comprises a look-up table which contains information pertaining to the storage format for the video data, and an adder which converts virtual addresses generated by the computer into physical addresses for the video buffer. With this feature, the computer can use the same addressing scheme to retrieve graphical data and video data, even though they are stored in different formats.

As a further feature of the invention, separate color look-up tables are employed for the graphic and video data. With this approach, the tables can be tailored to the individual formats of the respective types of data, and each type of data can be processed without loss of information or compromising the resulting display. In addition, different color look-up tables can be swapped for the graphical data, in response to the activation of different application programs, without affecting the video display.

Further features of the invention, as well as the advantages achieved thereby, are explained in detail hereinafter with reference to preferred embodiments illustrated in the accompanying drawings.

DETAILED DESCRIPTION

Generally speaking, the present invention is directed to a system for displaying video and graphic data on a common display medium, such as a CRT monitor or an LCD screen. To facilitate an understanding of the present invention, it is described hereinafter with reference to its implementation in a computer system that employs a graphical user interface of the type in which various kinds of data are displayed within windows in a workspace. The video presentation appears within one such window. It will be appreciated, however, that the practical applications of the invention are not limited to this particular embodiment. Rather, the invention can be successfully employed in any type of computer system in which both graphical and video information are displayed together.

Figure 1:
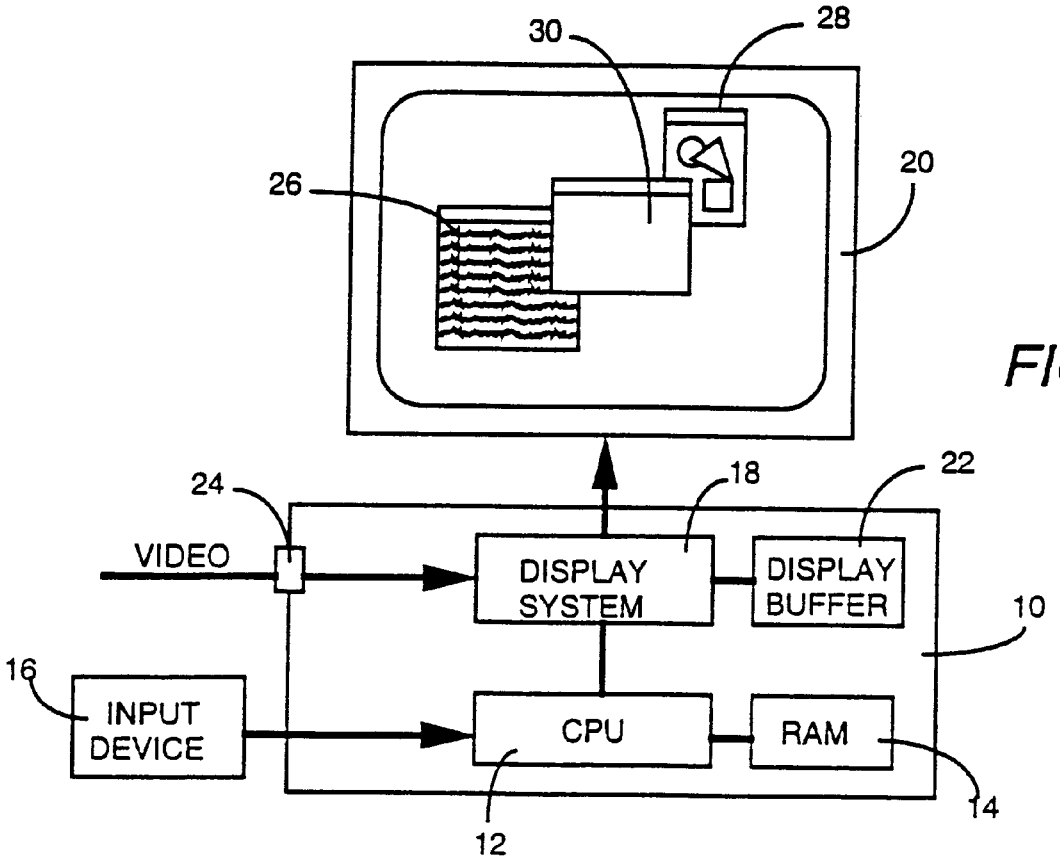
FIG. 1 is a general block diagram of a computer system of the type in which the present invention can be implemented.

FIG. 1 is a block diagram representation of a typical computer system in which the present invention might be implemented. The system comprises a computer 10, which includes a central processing unit (CPU) 12 and associated random access memory (RAM) 14. One or more input devices 16, such as a keyboard and a cursor control device, e.g., a mouse, trackball or pen, permit the user to control the operation of the computer. Information processed by the CPU is presented to a display system 18, which controls the display of that information on a suitable display device 20, such as a monitor or LCD screen. The actual information to be displayed on this display device 20 is stored in a display buffer 22. In essence, the display buffer 22 stores data which defines one or more parameters, such as color and intensity, for each pixel in the active display area of the monitor 20. In addition to the information generated within the computer, the system is also capable of displaying video presentations that are provided from an external source, such as a video tape player or a cable television feed. For this purpose, the computer includes a suitable video input port 24, by which a video signal is fed to the display system, where it is stored in the display buffer 22 and subsequently retrieved for display. Of course, the video signal can be previously stored in the computer, for example on a hard disk, and subsequently retrieved for display at a desired time.

In the illustrated embodiment, a graphical user interface is employed to present information to the user. An example of such an interface is the Finder which comprises a component of the operating system on MacIntosh® brand computers supplied by Apple Computer, Inc. In this type of user interface, information generated by application programs is displayed to the user within the confines of one or more windows which appear on the display screen. The windows themselves are graphical elements whose display is controlled by the graphical user interface running on the computer. The contents of the windows are determined by the various application programs being executed. Thus, for example, one window 26 may display the contents of a document being generated by a word processing program, and another window 28 may display a drawing created with a graphics program. The video information received via the input port 24 is displayed in another window 30, under the control of an associated application program. As illustrated in FIG. 1, the various windows can overlap one another. Typically, the window which appears in the foreground of the display, and which is not obscured by any other window, is associated with the application program and/or information currently being accessed by the user. In the example of FIG. 1, the video window 30 is currently in the foreground of the display.

Figure 2:
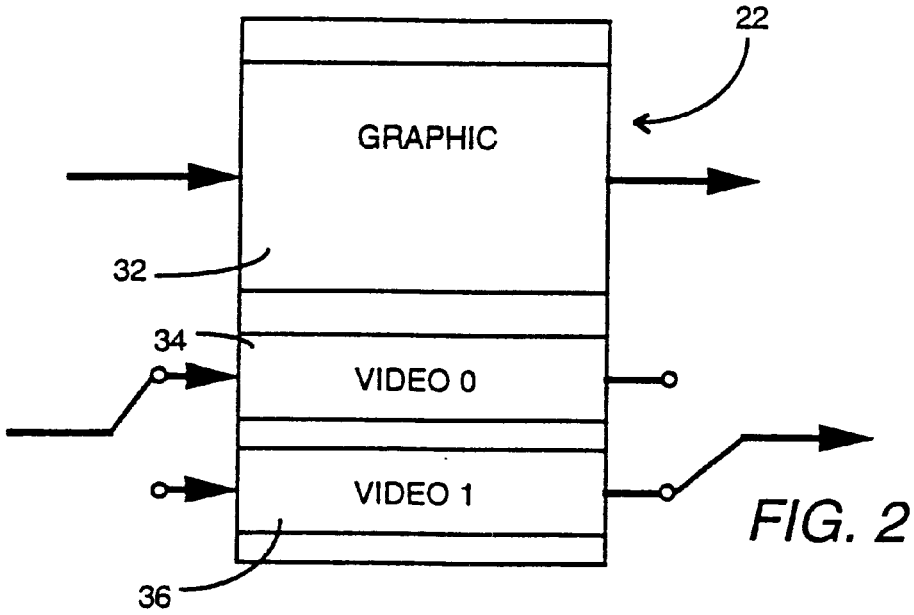
FIG. 2 is a diagram of the frame buffers in the display buffer.

The manner in which the graphic and video data is stored in the display buffer 22 is illustrated in FIG. 2. The display buffer is effectively divided into three frame buffers, i.e. three address ranges. One frame buffer 32 stores the graphical data generated by the CPU. The size of this frame buffer can vary, depending upon the size of the monitor and the number of bits of information that are used to define each pixel in the display. The other two frame buffers 34 and 36 store alternate frames of the incoming video signal. In operation, and as depicted in FIG. 2, an incoming video frame is stored in one of the frame buffers, e.g., 34, while the immediately preceding frame is retrieved from the other frame buffer 36 for presentation to the display device 20. At the end of the frame, the video frame buffer read and write operations switch state so that the next incoming frame is stored in the buffer 36 while the complete frame which was just received is retrieved from the buffer 34.

Figure 3:
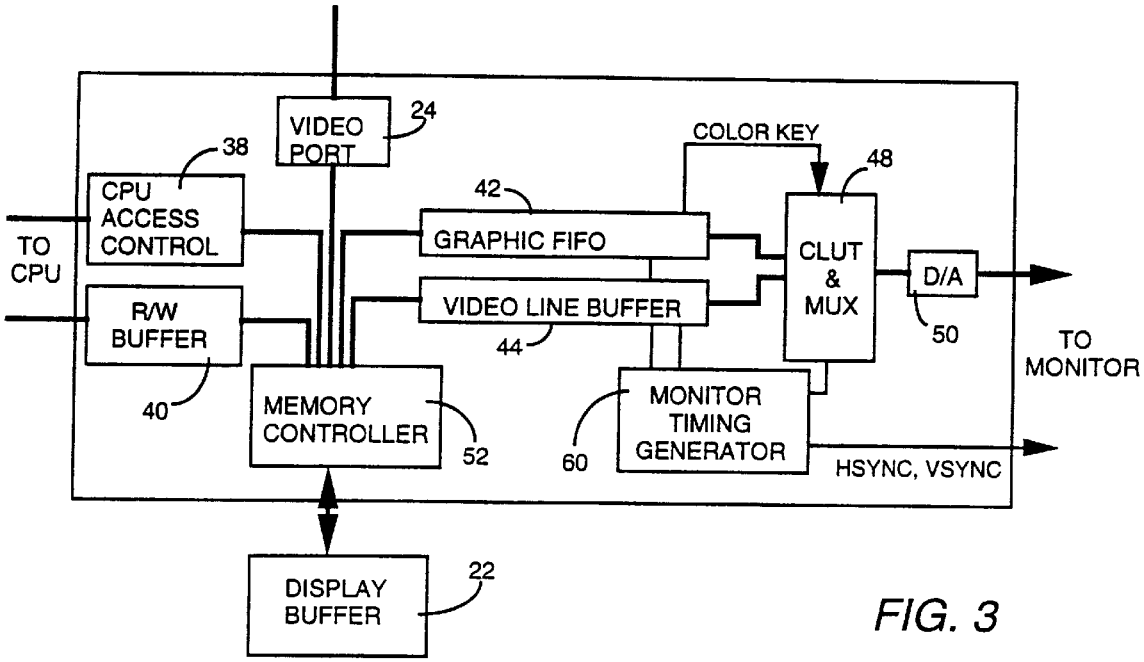
FIG. 3 is a more detailed block diagram of the display system.

The display system 18 is illustrated in greater detail in the block diagram of FIG. 3. Referring thereto, the CPU obtains access to the display buffer 22 through an access controller 38, which manages the transfer of data between the CPU and the buffer. Such access to the contents of the display buffer 22 may be desirable, for example, if the CPU is executing an image rendering program, in which the values of the display pixels are modified in accordance with various factors. Typically, the display buffer is implemented as a dynamic random access memory (DRAM). Since this display buffer is continually accessed by the display system to redraw information on the display device 20, the latency experienced by the CPU is relatively high, due to the relatively slow operating speed of a typical DRAM. Accordingly, a read/write buffer 40 is provided to enable the CPU to store write accesses to the display buffer. In addition, information requested by the CPU is loaded into the read/write buffer 40 from the display buffer 22. As a result, the display buffer does not have to wait for the completion of a CPU cycle to permit a read access by the display system.

Preferably, video data is written into and read from the display buffer in bursts, rather than on a single element access. For this purpose, therefore, the video input port 24 includes a FIFO register (not shown) to hold incoming data until a quantity of received data is sufficient to request a burst into one of the video frame buffers. Alternatively, information can be transferred from the FIFO register to a video frame buffer at any time that an access time slot is available for the display buffer 22.

A graphic FIFO register 42 holds a portion of the graphic frame buffer 32 that is destined for immediate transfer to the display device 20. A video line buffer 44 stores one video scan line of data. As explained in greater detail hereinafter, this buffer reduces the data traffic from the display buffer 22, by eliminating fetches of video data from the buffer during the time that the display of video within the window is active. Although not illustrated in FIG. 3, the graphic FIFO 42 and the buffer 44 each has an associated controller that generates requests for retrieving data from the display buffer 22. Pixel data that is stored in the graphic FIFO 42 and the video line buffer 44 is provided to a color lookup table (CLUT) 48. This table contains information necessary to map pixel data elements into display values that are utilized on the display device, such as RGB values. The CLUT circuit 48 includes a multiplexer which selects one pixel stream from the graphic FIFO 42 or the video line buffer 44 to send to the monitor. A digital value that is produced from the CLUT is provided to a digital-to-analog converter 50, where it is converted into an analog voltage.

A memory controller 52 controls access to the display buffer 22, in response to requests generated by each of the various subsystems which form the display system. The memory controller can satisfy pending memory access requests on the basis of a predetermined priority. For example, requests to load data into the video line buffer 44 may have the highest priority, to ensure that the video display is not interrupted, whereas CPU accesses and refresh cycles for the DRAM which forms the display buffer may have the lowest priority.

In operation, the buffers 42 and 44 function to manage the different data rates at which the various data generators and data consumers operate. Prior to the start of a display scan line on the display device, a number of elements, i.e., bytes of information, are placed in the graphic FIFO 42 in a burst. For example, a number of elements equal to one-half of the total capacity of the FIFO can be initially loaded. During the scanning of the monitor, pixel data is retrieved from the FIFO. Whenever the FIFO is less than one-half full, a request is made of the controller 52 to place more data into the FIFO. Thus, another group of elements is transferred from the display buffer 22 to the FIFO 42. As long as the time required to complete the transfer request is less than the time needed to exhaust the previously stored data in the FIFO, the graphic data to the display is not interrupted. This transfer time will typically be the sum of a burst transfer from the display buffer 22 to the FIFO 42 and the access latency of the memory controller 52.

Figure 4:
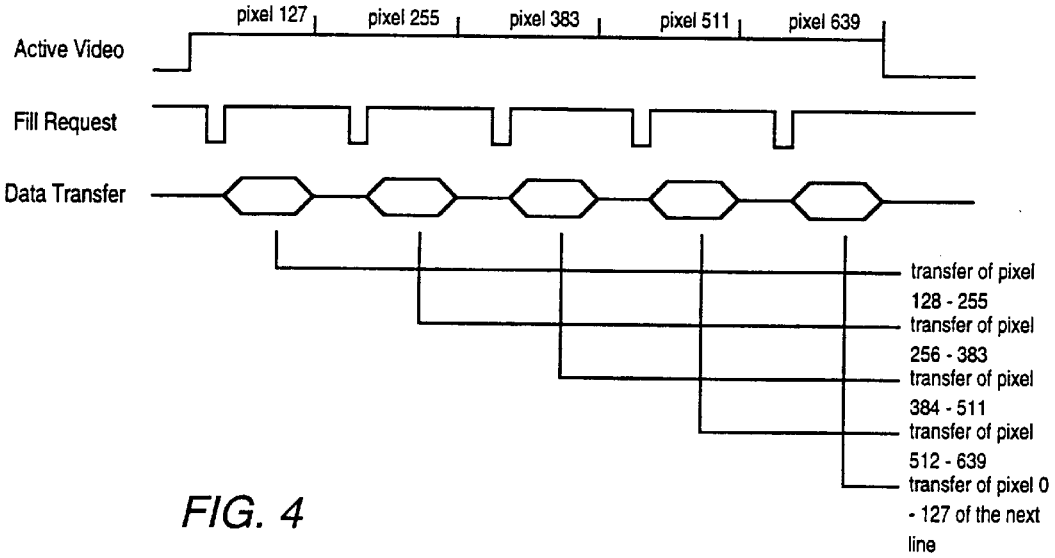
FIG. 4 is a timing diagram illustrating the manner in which graphical data is loaded into the graphic FIFO.

FIG. 4 illustrates the operation of a graphic FIFO request for an example in which the display device has a width, i.e., a scan line length, of 640 pixels, and operates with eight bits per pixel. The graphic FIFO 42 has a capacity of 2048 bits, i.e. 256 pixels. At the beginning of a scan line, the FIFO 42 holds the first 1024 bits, i.e., 128 pixels, for that line. As the line is being scanned, data is removed from the FIFO. Each time the FIFO is less than half full, a request for a transfer is made. After some period of time, the transfer is completed. Each transfer sends the data for the next 128 pixels. As the scanning of the current line nears completion, data at the start of the next scan line is fetched. During the time when graphic data is not being transferred into the FIFO, the display buffer can be accessed to fulfill any pending memory accesses, for example, from the CPU.

To place video information on the monitor, both video and graphic pixel data must be retrieved from the display buffer 22. For each video pixel position, graphic pixel data for that same position must be retrieved. This is due to the fact that, at any given time, the video pixel data may need to be replaced by the graphical data for the same pixel location. For example, with reference to FIG. 1, if the user should activate the window 28 to bring it to the foreground of the display, the lower left corner of that window would suddenly overlap the upper right corner of the video presentation. In operation, therefore, both the graphical and video pixel data for pixel locations covered by the video display needs to be present in their respective buffers. The correct data to display is selected by the multiplexer within the CLUT circuit 48, for example in response to color key information contained in the graphic data.

Figure 5:
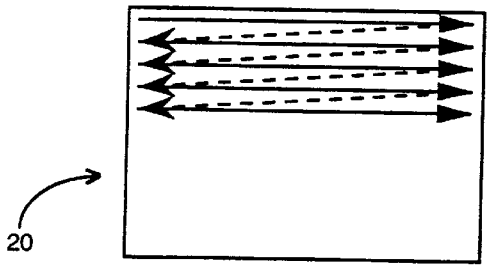
FIG. 5 is an illustration of the rasterized scanning of a CRT monitor.
Figure 6:
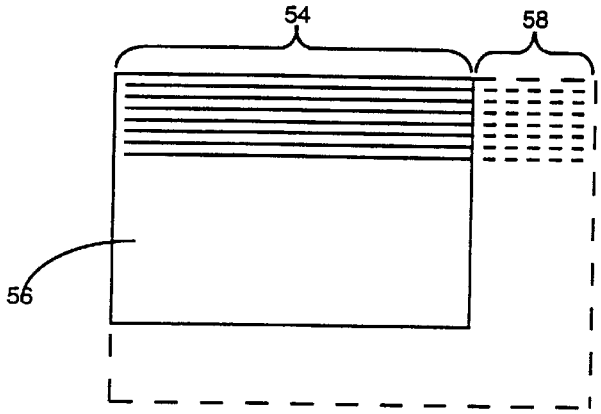
FIG. 6 is an illustration of the two components of a video scan line.

If the video data and graphic data are retrieved from the display buffer 22 simultaneously, a high speed memory would be required. In accordance with the present invention, however, the bandwidth requirements of the memory can be reduced by employing the horizontal blanking time inherent to a video signal. This concept is described with reference to FIG. 5. As is well known, a typical CRT monitor operates as a raster display, in which the displayed information is presented in the form of parallel scan lines. In FIG. 5, each scan line is represented by a solid arrow going from left to right. At the end of each scan, there is a retrace period, also known as the horizontal blanking interval, during which time the electron guns which generate the display are reset from the right side of the display to the left side, to begin the next scan line. Each retrace is represented in FIG. 5 by a dashed arrow going from right to left. In essence, therefore, each scan line consists of two components, an active part and a blanked part. The scan lines have been redrawn in FIG. 6 to better illustrate this concept. The active part 54 of each scan line comprises the visible information that is displayed on the monitor, and is represented by the solid lines within the active area 56 of a displayed frame. The blanked component 58 represents that portion of the scanning time during which no visible information is being displayed. This is represented in FIG. 6 by the dashed lines outside of the active display area 56. As also depicted in FIG. 6, there is a blanked portion at the end of each frame, known as the vertical blanking interval, during which time the electron guns are reset to the top of the display for the beginning of the next frame.

Figure 7:
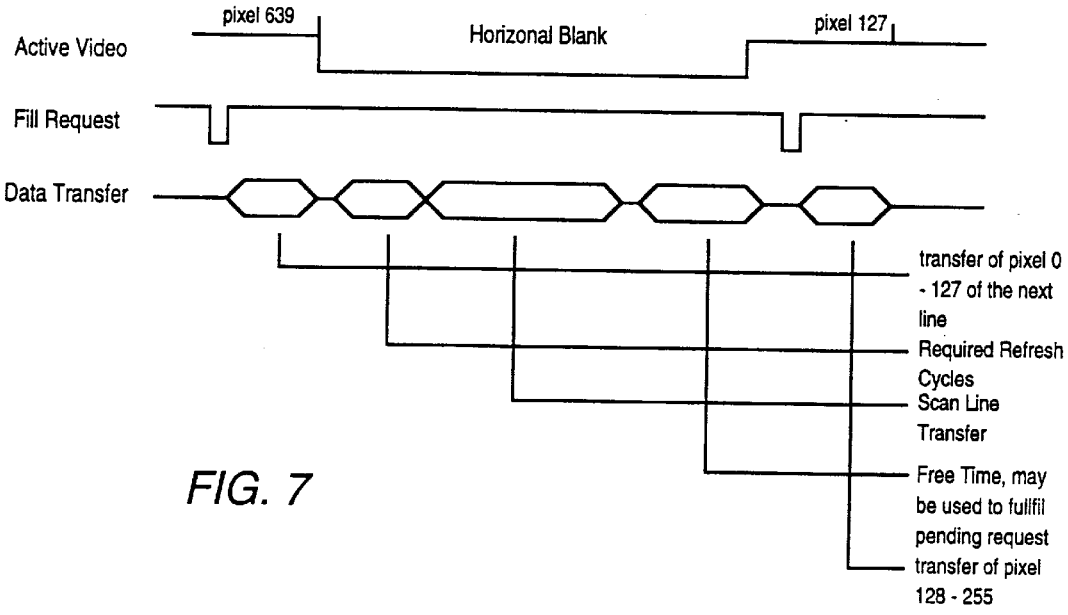
FIG. 7 is a timing diagram illustrating the loading of graphical data and video data into their respective buffers.

In accordance with the present invention, these two components of a video scan line are used to control the interleaving of video and graphic data that is read from the display buffer 22, and thereby reduce bandwidth requirements. Referring to the timing diagram of FIG. 7, graphic data is retrieved from the display buffer 22 during the active component 54 of each scan line. Thus, in the example described above, the data from the first 128 pixels of a line is transferred as a burst from the display buffer 22 to the graphic FIFO 42 near the end of the active portion of the previous line. At the end of this burst, any refresh cycles that are required for the display buffer 22 can be carried out. During the horizontal blanking interval 58 between active scan lines, the video data for the next scan line is transferred to the video line buffer 44 from the display buffer 22, again as a burst. Any free time that remains after this burst can be utilized to fulfill other pending requests. After the next scan line has begun, the next burst of 128 pixels (1024 bits) is transferred once the graphic FIFO 42 is less than half full.

The timing of these data transfers is controlled by a monitor timing generator 60 within the display system 18. This generator, which can be responsive to an external reference clock (not shown), generates the horizontal sync and vertical sync signals which are used to drive the monitor. The generator also controls the transfer of pixel data from the FIFO 42 and the buffer 44 to the CLUT 48. The horizontal sync signal, or a phase-shifted derivative thereof, is supplied to the controllers for each of the graphic FIFO 42 and the video line buffer 44, to control the times at which requests for data transfer are generated by these subsystems relative to the active and blanked portions of each video scan line.

When the CPU 12 stores graphic data in the graphic frame buffer 32, it preferably employs a packed pixel method for organizing the data within the buffer. In this method, the data for successive pixels within a scan line of the monitor is stored at sequential address locations within the buffer. Furthermore, the first byte of data for the next line immediately follows the byte containing the data for the last pixel in the preceding line. In essence, each scan line forms a record in the frame buffer, whose length is a function of the number of pixels in the scan line and the number of bits per pixel. Each record starts at the address of the byte following the byte which contains the pixel data for the last pixel of the previous scan line. This approach provides a consistent, readily determinable offset between any two pixels. For example, given the address for any pixel in the display, the address for the pixel at the same location in the next scan line will be offset by an amount equal to the number of bytes in a single scan line.

The memory organization of the pixel information for the video data can be different from that for the graphic data. Unlike graphic data, which can be represented by different numbers of bits per pixel, video pixel data is typically fixed at 16 bits, i.e. two bytes per pixel. To aid in the transfer of data from the display buffer 22 to the video line buffer 44, scan line data is sent in a burst from the display buffer 22 to the video line buffer 44 in a single row address transaction, i.e. one row of the memory at a time. The length of a row in a memory is generally a power of two. For example, it may be equal to 2048 bytes. Conversely, the length of a scan line may not be a power of two. As a result, an integral number of scan lines do not fit exactly within one row of the memory.

Figure 8:
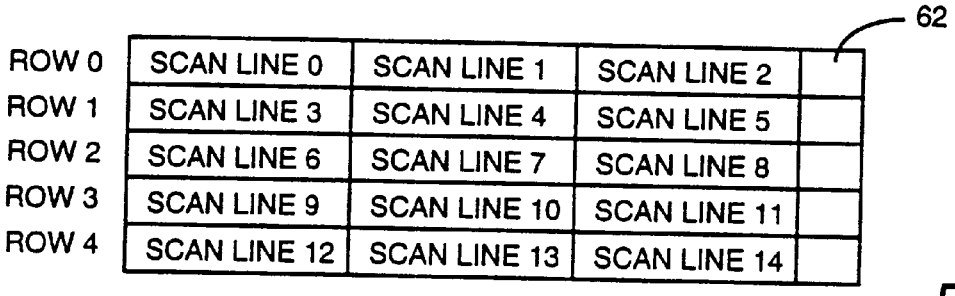
FIG. 8 is a block diagram of the memory organization for the video frame buffers.

This concept is illustrated in FIG. 8 for the situation in which the video presentation is operating in a typical mode of 320 by 240 pixels, where each scan line comprises 640 bytes. If the memory row has a length of 2048 bytes, it can be seen that three complete scan lines will fit into a row of the display buffer, with a gap 62 of 128 unused bytes at the end of each row. In other words, the pixel data is not packed in the memory. If it were, the data for some of the scan lines, e.g., scan line 3, would be split over two rows of the memory. In such a situation, when a data burst transfer occurs, an incomplete scan line would be sent to the video line buffer 44. In contrast, by organizing the video data as shown in FIG. 8, only complete scan lines are transferred to the buffer in a burst.

When the memory organization of the type illustrated in FIG. 8 is employed, there is not a consistent offset between pixels. For example, the first pixel of scan line 1 is offset from the first pixel of scan line 0 by 640 bytes. Similarly, the first pixel of scan line 2 is offset from that of scan line 1 by 640 bytes. However, because of the 128 unused bytes at the end of row 0, the first pixel of scan line 3 is not offset from that of scan line 2 by the same amount as the previous scan lines. Consequently, a more complex addressing scheme must be employed by the CPU in order to obtain the video pixel data.

Figure 9:
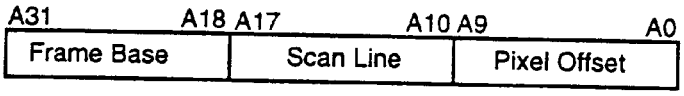
FIG. 9 is a block diagram of an address field for the display buffer.

To overcome this situation, the CPU read/write buffer 40 includes an address translation unit. The function of this unit is to give the illusion to software running on the CPU of a constant address offset between pixels in the various video scan lines. In operation, the video frame buffers 34 and 36 are accessed by means of an address field that comprises three parts. An example of a 32-bit address pursuant to this concept is illustrated in FIG. 9. Referring thereto, the 14 most significant bits of the address field (A18–A31) identify the base address of the particular video buffer being accessed, e.g. the buffer 34. The next eight bits of the field (A10–A17) define a desired scan line. The last 10 bits of the field (A0–A9) define a byte address within the scan line.

Figure 10:
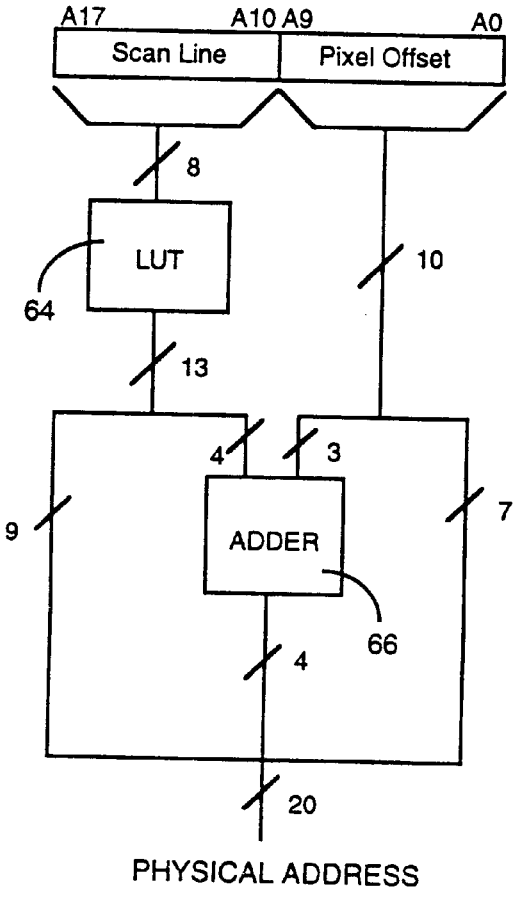
FIG. 10 is a schematic diagram of the address translator.

The structure of the address translation unit is illustrated in FIG. 10. Basically, the translator modifies the lower 18 bits of the address, to determine the physical address for the desired information within one of the frame buffers. Referring to FIG. 10, the eight bits of the scan line component of the address field form an index into a lookup table 64. This lookup table produces a 13-bit value. The most significant nine bits of this value identifies the appropriate row address within the video buffer. In essence, this value is determined by dividing the scan line number by three (the number of scan lines per row of the memory), and multiplying the integer value of this result by 2048 (the number of bytes in a row). The least significant four bits of the value produced by the lookup table is equal to three times the fractional portion of the preceding quotient (which indicates whether the scan line of interest is in the first, second or third position in a row) multiplied by 640 (the number of bytes per scan line). These four bits are added to the three most significant bits of the pixel offset portion of the address field, to generate a 4-bit value. The result is a 20-bit value that forms the physical address within the buffer. That address can be expressed by the following formula:

Address=((((Int(ScanLine/3))*2048)+(((Frac(ScanLine/3))*3)*640)+Pixel Offset

The base address of the desired frame buffer is added to the result of this translation, to form the final address. Consequently, the addressing of the video frame buffers 34 and 36 appears to the CPU to be the same as that for the graphic frame buffer 32.

As discussed previously, video data is typically presented in a standard format of 16 bits per pixel. Conversely, graphic data can be represented by a number of different bits per pixel, depending upon the capabilities of the monitor and the graphics software being executed. In a typical computer, the graphic data might be formatted as 1, 2, 4, 8 or 16 bits per pixel, where different programs may employ different formats. Furthermore, different application programs may employ different color pallets, even if they use the same number of bits per pixel. For example, a pixel depth of eight bits per pixel permits 256 different colors to be employed. However, the set of 256 colors that are employed by one program may be different from the set of 256 colors that are employed by another program. Each different pixel format, as well as each different color pallet, requires different functionality from the color lookup table 48.

Figure 11:
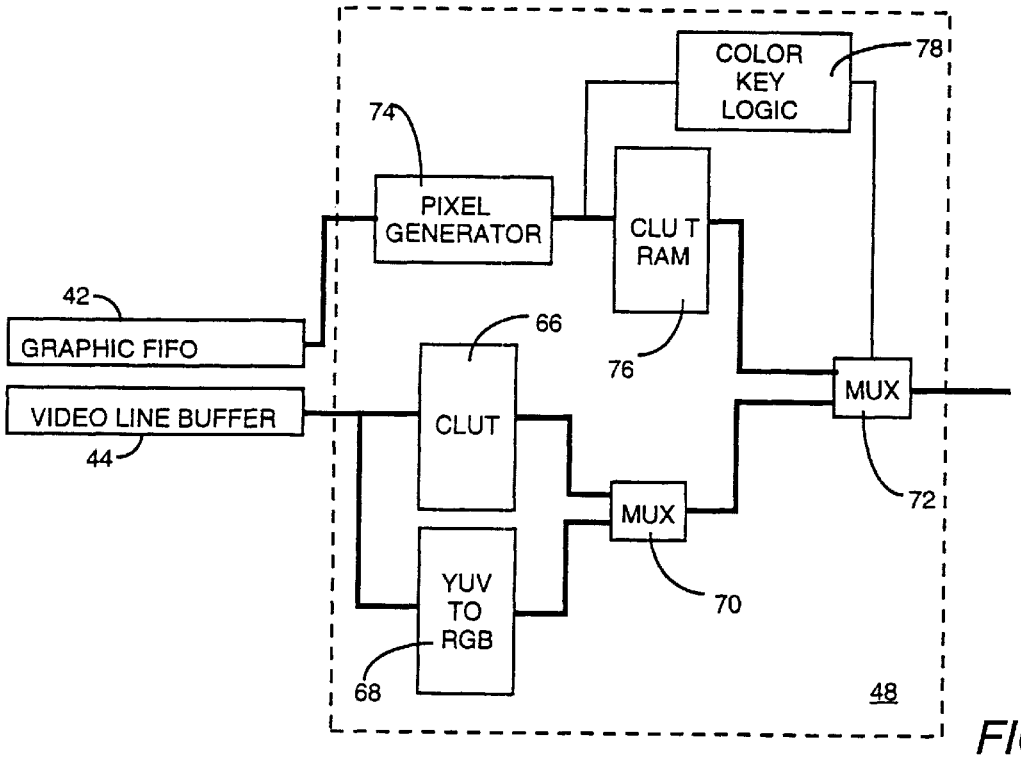
FIG. 11 is a block diagram of the color look-up table and multiplexer circuit.

In accordance with another feature of the present invention, multiple color lookup tables are employed to accommodate the different formats and different color pallets employed by the video and graphic data. A block diagram which illustrates the configuration of the color lookup table and multiplexer 48 is illustrated in FIG. 11. Referring thereto, the data stored in the video line buffer 44 might comprise 16 bits per pixel. This data is provided to a video CLUT 66 stored in a RAM, and to a YUV-to-RGB converter 68. The YUV-to-RGB converter operates in accordance with well known principles, to convert the video luminance and chrominance data into equivalent red, green and blue components, for example 8 bits each to produce a 24-bit value. The video CLUT 66 also transforms the data from the video line buffer 44 into a 24-bit RGB value. The value obtained from the video CLUT may not be the same as that generated by the YUV-to-RGB converter, however, since it may take into account the color space characteristics of the display device 20, or other characteristics associated with the system. The 24-bit values produced by the video CLUT 66 and the converter 68 are fed to a video multiplexer 70, which selects one of the two values and presents it to a pixel source multiplexer 72. The particular one of the two values that is chosen by the video multiplexer 70 can be determined by the user, or selected in accordance with other designated factors.

Data which is retrieved from the graphic FIFO 42 is presented to a pixel generator 74. This device transforms the data for the individual pixels into three groups of bits which respectively form the index values for graphic red, green and blue CLUTs stored in a RAM 76. For example, each group might comprise eight bits. If the system is operating in a mode where less than 8 bits per pixel are employed, the active size of the index fields presented to the CLUT 76 is less than 8 bits wide. For example, if the mode is 4 bits per pixel, the least significant 4 bits of each group represents the index value for the associated CLUT, and the 4 most significant bits are given a value of zero. The color lookup table 76 generates a value having the same number of bits as the values generated by the CLUT 66 and the converter 68, i.e. twenty-four in the present example. This value is also provided to the pixel source multiplexer 72. One or more bits in the output of the pixel generator can be provided to a color key logic circuit 78. As described previously, on the basis of this information the logic circuit determines whether the graphic data or the video data has precedence, and controls the pixel source multiplexer 72 accordingly. The output of the pixel source multiplexer is provided to the video digital-to-analog converter 50.

This arrangement, in which different color lookup tables are respectively employed for the graphic data and the video data, provides a great deal of flexibility. In particular, the video data is not limited to the same number of bits per pixel as the graphic data. Rather, the video data can still be processed at 16 bits per pixel, even if the graphic system is operating at only 4 bits per pixel. Furthermore, different graphic lookup tables can be switched in and out of the RAM 76, to accommodate different graphic programs, without affecting the video display.

From the foregoing, it can be seen that the present invention provides a number of advantages in a computer system where both video and graphic data are displayed simultaneously. For example, a single memory can be employed to store both the video and graphic data. By interleaving the retrieval of graphic and video data, in accordance with the active and blanked portions of a video scan, a memory with lower bandwidth capabilities, and hence lower cost, can be readily employed. Furthermore, with the use of an address translator, the video data can be stored in a format different from the graphic data, but be accessed by the computer in the same manner as the graphic data. In addition, the use of respective color lookup tables for the video and graphic data provides a great deal of flexibility in the use of different graphic formats without adversely affecting the video display.

It will be appreciated by those of ordinary skill in the art that the present invention can be embodied in other specific forms without departing from the spirit or essential characteristics thereof. The presently disclosed embodiments are considered in all respects to be illustrative and not restrictive. The scope of the invention is indicated by the appended claims, rather than the foregoing description, and all changes that come within the meaning and range of equivalence thereof are intended to be embraced therein.

What is claimed is:

1. A computer system, comprising:

a central processing unit for generating graphical data;

a video input port for receiving video data;

a memory for storing said graphical data and said video data, wherein the graphical data is stored in a first part of the memory in a first form and the video data is stored in a second part of the memory in a second form; and a translation unit for converting addresses intended for one of said two parts of the memory from an address associated with one of said forms of storage into an address associated with the other of said two forms of storage.

2. The computer system of claim 1 wherein said first form of storage is a packed pixel form and said second form is a non-packed form.

3. The computer system of claim 2 wherein said memory comprises a plurality of rows and wherein, in said second storage form a row of data in said second part comprises video data for an integer number of scan lines of a video frame and unused address spaces.

4. The computer system of claim 2 wherein said translation unit converts addresses intended for said second part of the memory into an address for non-packed data.

5. The computer system of claims 2 wherein said translation unit converts addresses associated with a packed-pixel form of data storage into addresses associated with a non-packed form of data storage.

6. The computer system of claim 1 wherein said first form of data storage is associated with a first addressing technique, and said second form of data storage is associated with a second, different addressing technique.

7. The computer system of claim 1 wherein said first and second parts of said memory are contained within a single memory device.

8. A computer system, comprising:

a central processing unit for generating graphical data;

a video input port for receiving video data; and a display system for presenting said graphical data and said video data to a display device, said display system including:

a first memory storing a first color look-up table, for receiving said graphical data and converting said graphic data into a predetermined format for presentation to the display device;

a second memory storing a second color look-up table, for receiving said video data and converting said video data into said predetermined format; and a pixel-source multiplexer for receiving the converted data from each of said first and second memories and selectively presenting the received data from one of said memories to the display device.

9. The computer system of claim 8 wherein said display system further includes a YUV-to-RGB converter for converting video data in a YUV format into RGB data having said predetermined format, and a second multiplexer for selectively presenting converted data from said YUV-to-RGB converter or said second memory to said pixel-source multiplexer.

10. The computer system of claim 8 wherein said first memory stores different color look-up tables which are determined by software programs being executed on said central processing unit.

11. The computer system of claim 8 wherein said graphical data and said video data are represented by different numbers of bits per pixel, respectively, and said first and second color look-up tables convert each of said types of data into the same number of bits per pixel.

12. A method for displaying images, comprising the steps of:

generating graphical data;

receiving video data;

converting said graphical data into a predetermined format using a first color look-up table;

converting said video data into said predetermined format using a second color look-up table; and receiving said converted graphical data and said converted video data at a pixel-source multiplexer and selectively presenting the received data for display.

13. The method of claim 12 further comprising the steps of:

converting video data in a YUV format into RGB data having said predetermined format; and selectively presenting said converted RGB data or said video data converted using said second color look-up table to said pixel source multiplexer.

14. The method of claim 12 further comprising the steps of:

storing different color look-up tables for said graphic data and selectively switching between said color look-up tables in accordance with executing software programs.

15. The method of claim 12 wherein said graphical data and said video data are represented by different numbers of bits per pixel, respectively, and said first and second color look-up tables convert each of said types of data into the same number of bits per pixel.

16. A method for data storage comprising the steps of:

generating graphical data;

receiving video data;

storing said graphical data in a first location in a first form associated with a first addressing technique and said video data in a second location in a second form associated with a second, different addressing technique; and converting addresses intended for one of said graphical data and video data from an address associated with one of said forms into an address associated with the other of said two forms of storage.

17. The method of claim 16 wherein said first form of storage is a packed pixel form and said second form is a non-packed pixel form.

18. The method of claim 17 wherein said converting step converts addresses intended for said second location into an address for non-packed data.

19. The method of claim 17 wherein said converting step converts addresses associated with a packed-pixel form of data storage into addresses associated with a non-packed form of data storage.

20. The method of claim 16 wherein said first and second locations are located within a single memory device.

* * * * *